US007644925B2

(12) United States Patent
Hughes et al.

(10) Patent No.: US 7,644,925 B2
(45) Date of Patent: Jan. 12, 2010

(54) METHOD AND APPARATUS FOR A TRICK-TAKING CARD GAME

(76) Inventors: Janice Maryan Hughes, 7 Summit Avenue, Thunder Bay, ON (CA) P7B 3N7; Christine Anne Debruyne, 36 Concord Crescent, London, ON (CA) N6G 3H6

( * ) Notice: Subject to any disclaimer, the term of this patent is extended or adjusted under 35 U.S.C. 154(b) by 464 days.

(21) Appl. No.: 11/535,402

(22) Filed: Sep. 26, 2006

(65) Prior Publication Data

US 2008/0036149 A1 Feb. 14, 2008

(51) Int. Cl.
*A63F 1/00* (2006.01)

(52) U.S. Cl. ..... 273/292; 273/303; 273/308

(58) Field of Classification Search ..... 273/292, 273/303–308

See application file for complete search history.

(56) References Cited

U.S. PATENT DOCUMENTS 4,222,572 A * 9/1980 Baker ..... 273/306
5,467,997 A * 11/1995 Bashirzadeh ..... 273/302
5,791,652 A * 8/1998 Nielsen ..... 273/305
6,322,077 B1 * 11/2001 Braunlich et al. ..... 273/292
6,601,851 B1 * 8/2003 Sakamoto et al. ..... 273/308
7,055,823 B2 * 6/2006 Denkewicz, Jr. ..... 273/304
7,144,013 B2 * 12/2006 Tanaka ..... 273/308
7,392,986 B2 * 7/2008 Gress ..... 273/292
2002/0043764 A1 * 4/2002 Imhof ..... 273/292

* cited by examiner

*Primary Examiner*—Benjamin H Layno

(57) ABSTRACT

A method and apparatus for playing a trick-taking card game for two or more players that includes two decks of playing cards: a numbered character card deck and a modifier card deck. Each player's goal is to play a card, or combinations of cards, that is/are higher in numerical rank value than their opponents' cards in order to win the trick in each round of play. Players can improve their chance of winning the round by playing, in their turn and in conjunction with one character card, one or more modifying cards that they possess in their hand to increase the numerical rank value of their played character card or decrease the numerical rank value of the other players' cards. Tricks are collected for points in multiple hands comprising a game. The player with the greatest number of points at the end of the game is declared the winner.

13 Claims, 5 Drawing Sheets

METHOD AND APPARATUS FOR A TRICK-TAKING CARD GAME

TECHNICAL FIELD

This invention relates generally to games, particularly those played with cards.

BACKGROUND INFORMATION AND PRIOR ART

Card games have entertained people through the ages. Among their greatest attributes are their highly versatile nature and compact size. In addition, card games are relatively inexpensive to purchase, typically, because play does not usually require additional equipment, such as a game board, token markers, and dice that can contribute to the overall production cost of the game.

A seemingly endless variety of card games have been created over the years; however, most are played with a standard deck of 52 cards that is divided into four different suits, each of which includes cards that rank from Ace (1) to King (13). Cards ranking from Jack (11) to King are considered "face cards" because they are commonly illustrated with people's faces; these cards are sometimes impressed with special value in a game that transcends their high rank value. A standard deck of cards also includes two or more so-called "joker" cards that are awarded special purpose specific to a game—one such purpose being "wild cards" to which any rank value may be applied.

One of the most prolific forms of card games is "trick-taking" games, which have a distinct and common play structure. They are characterized by the concept of a "trick" that is usually a single round of play in which each player contributes one card from her/his hand. Typically, players are only entitled to play one card in their turn and no player is allowed to abstain from playing a card. Once all players have contributed a card to the trick, these cards are removed from play with the points accumulated in the trick being attributed to the player who has played the winning (usually highest value) card. After each trick, one player will be obligated to play the first card of the next trick and, as such, the game continues until all cards have been played and all tricks collected. Although trick-taking games are comparatively simple in structure—hence, relatively straightforward to learn—their immense popularity likely stems from their innate mathematical and strategic components that add considerable complexity to the game; consequently, mastering a trick-taking game can be quite challenging.

DESCRIPTION OF HOW THE INVENTION ADDRESSES A TECHNICAL PROBLEM

Most card games are played with a conventional deck that, by nature, provides for limited, often unidimensional, numerical relationships between cards. For example, the conventional deck has only two, or perhaps, three degrees of hierarchical ranks: cards have ranks based on their numerical value and face cards often generally outrank other cards. In addition, some games, such as Bridge, affix hierarchical rank on suits whereby some cards of a specific numerical value will outrank other cards of the same value due to differences in their suit.

Although this intrinsic design of the conventional card deck has spawned the invention of a multitude of games, its limitations have created a typical generalized flaw in their play, one that is most evident when players vary in their experience with the game or children play the game with adults. This is because most card games, particularly trick-taking games, lack the possibility for significant catastrophic events to occur during game play, due in part to the simplistic numerical relationships between cards. Consequently, experienced players "learn" to win by fine-tuning points of strategy and developing their ability to remember what cards have been played. Thus, experienced players perpetually dominate game play by winning repeatedly, and often resort to "letting other players win" occasionally in order to maintain a collegial relationship among players. This is particularly problematic when adults play with children.

The result of this intrinsic flaw, over span of time, has been the divergence of card games into two categories—children's games (i.e., easy) and adults' games (i.e., more difficult)—with the invention of simple games, such as Go Fish and Crazy Eights, that primarily use chance to provide an opportunity for children and adults (or players of varying experience) to meet on a level playing field. Unfortunately, most players (except, perhaps, the very youngest) rapidly tire of these simplistic games.

The present invention game alleviates this problem through the use of two different decks of cards—a character card deck and a modifier card deck—that are used in conjunction during game play. The character card deck improves on the conventional deck of cards because it has a multitude of fine and coarse degrees of hierarchical rank among cards. For example, numerical ranking occurs at the level of individual cards and among several groups of cards within a suit or between suits. In addition, cards are grouped not only by suit, as in the conventional deck, but also by various interrelated attribute groups that are independent of suit and numerical value. These characteristics allow for greater interplay between cards, thus, providing more variable outcomes in game play. In addition, the modifier deck allows for substantial changes to numerical rank values of character cards during game play. By design, specific modifying cards can variably influence one or more features of the character cards including numerical value, suit, hierarchical rank within a suit, or attribute group(s) to which the character cards belong. In some cases, modifying influences can be catastrophic to one's opponents.

Thus, the greatest improvement of the present invention game over games played with a conventional card deck is the introduction of additional variables. It is more difficult, and often less fruitful, for players to win by simply remembering what cards have already been played. The plethora of modifier cards, not all of which may be played in any hand, cannot be predicted and, consequently, a card of high numerical value may not outrank an appropriately-chosen character/modifier card combination played by an opponent. As a result, the focus of game strategy occurs first at the unit of the trick and second at the unit of the hand. This allows for children or inexperienced players to do as well as experienced players because they do not require comprehensive strategic planning over the entire hand when first dealt, which is characteristic of games such as Bridge. Furthermore, the modifying deck remediates the effect of "luck of the draw" (i.e., getting a good hand) that hampers the entertainment value of many card games.

The present invention game also improves upon many conventional card games because it can be played with two or more players with only minor modification to the typical 4-player game. Most trick-taking card games, such Hearts and Bridge, require a fixed number of players, typically four. It is not always possible to find three others with which to play. Moreover, card games that play well with only two players are rare, and those that exists (e.g., Cribbage) are exceedingly popular, thus attesting to their value.

The full benefits of the present invention game over conventional card games will be further described and elucidated in the detailed Description of the Invention that is presented below.

BRIEF DESCRIPTION OF THE FIGURES

The features of the present invention game, which are believed to be novel, are presented with particularity in the appended claims. The invention game may be best understood by reference to the following description taken in conjunction with five accompanying diagrams (FIGS. 1 to 5) in which useful elements are identified with numbers on the illustrations and detailed description that follows.

DETAILED DESCRIPTION OF INVENTION

Figure 1:
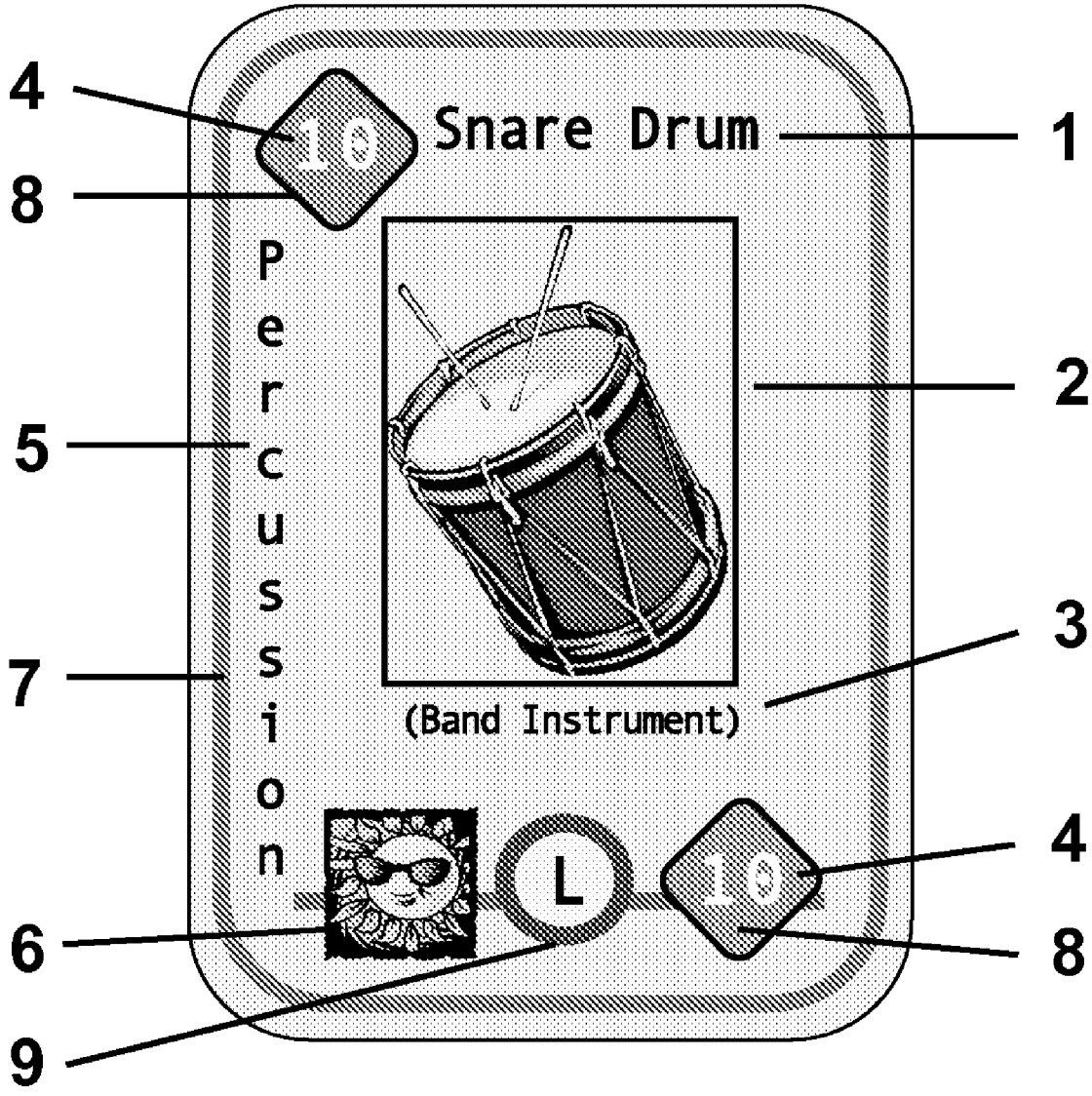
FIG. 1 shows the front view of a typical numbered character card used in playing the present invention game.
Figure 2:
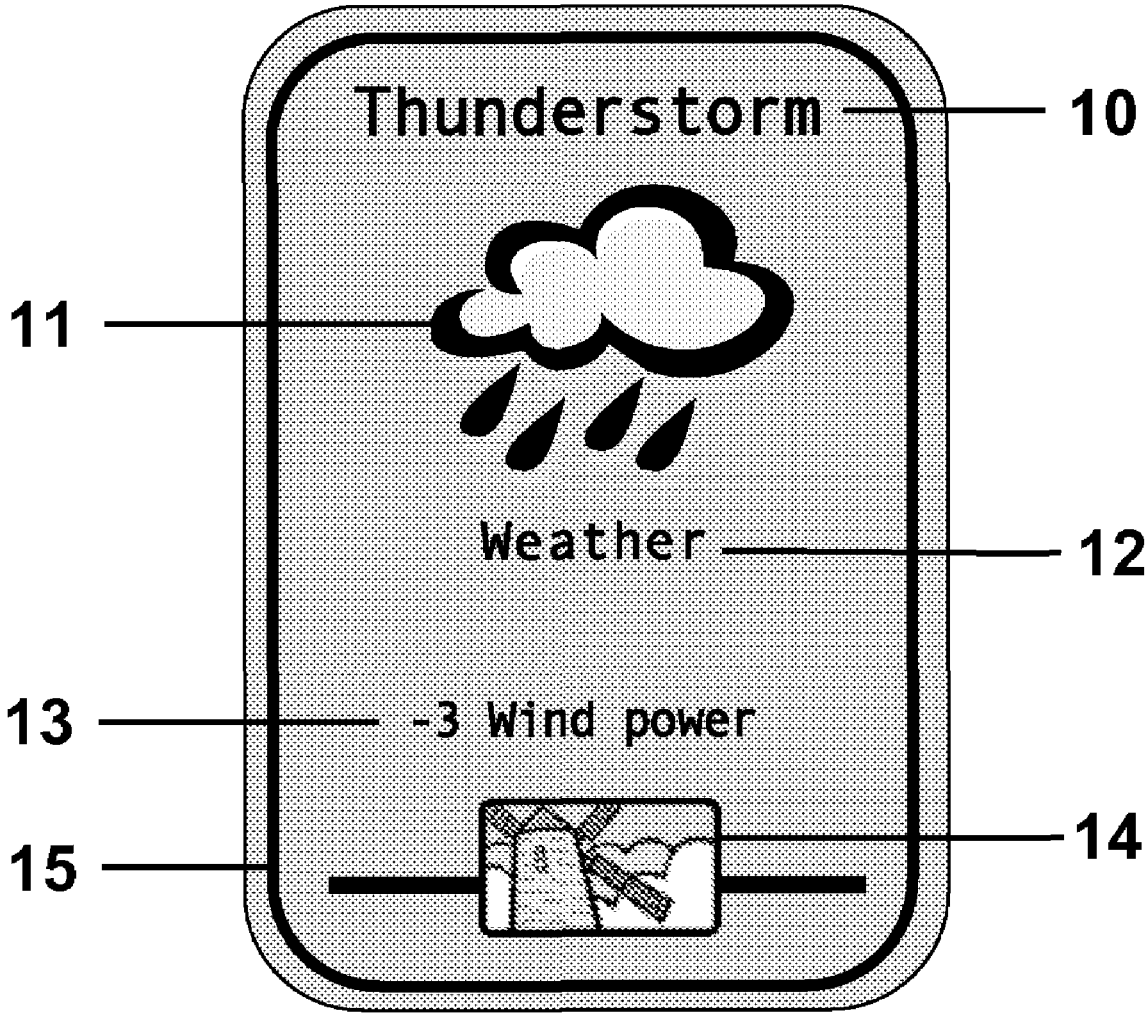
FIG. 2 shows the front view of a typical modifier card used in playing the present invention game.
Figure 3:
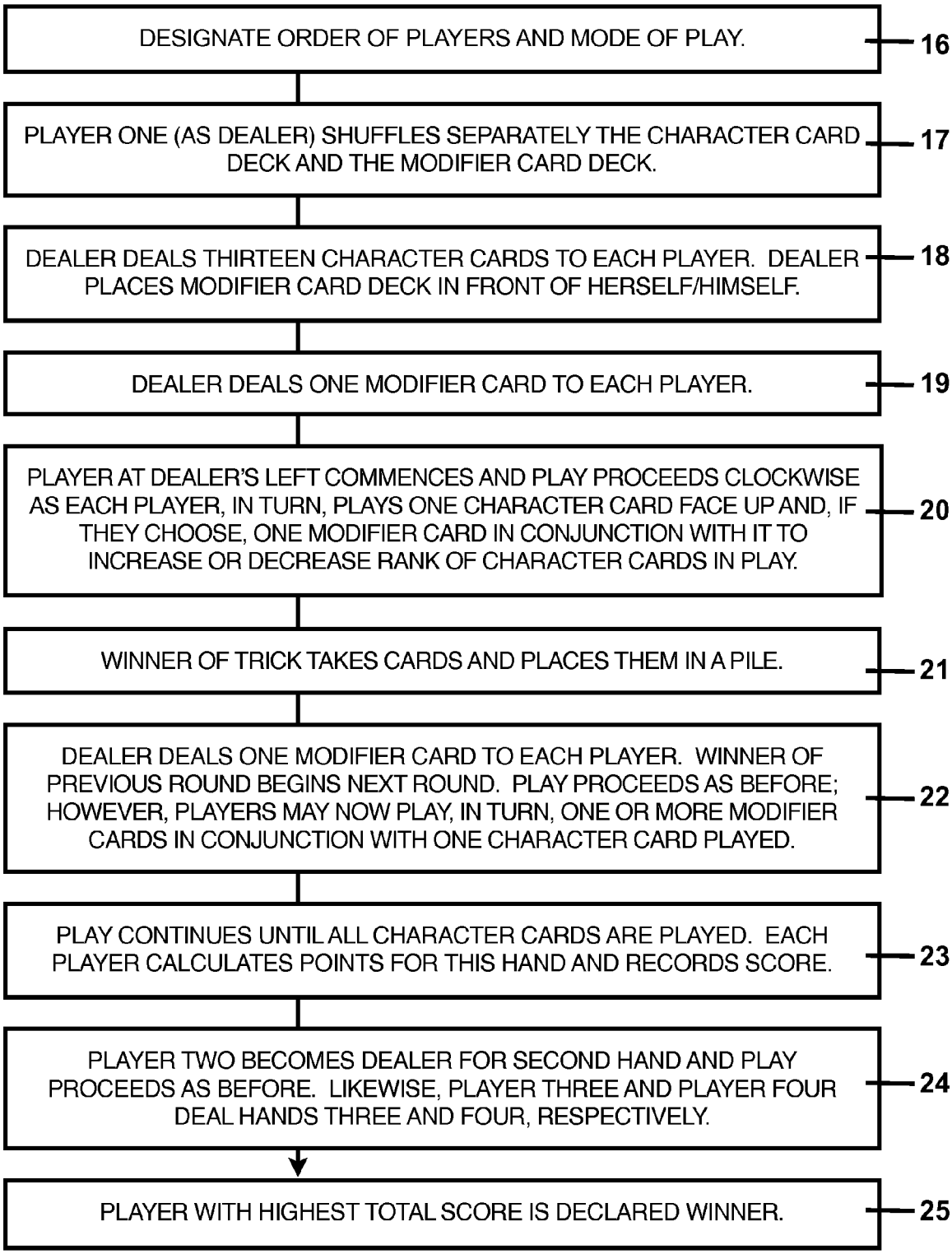
FIG. 3 shows a flow diagram of the game play of the typical 4-player version of the present invention game.
Figure 4:
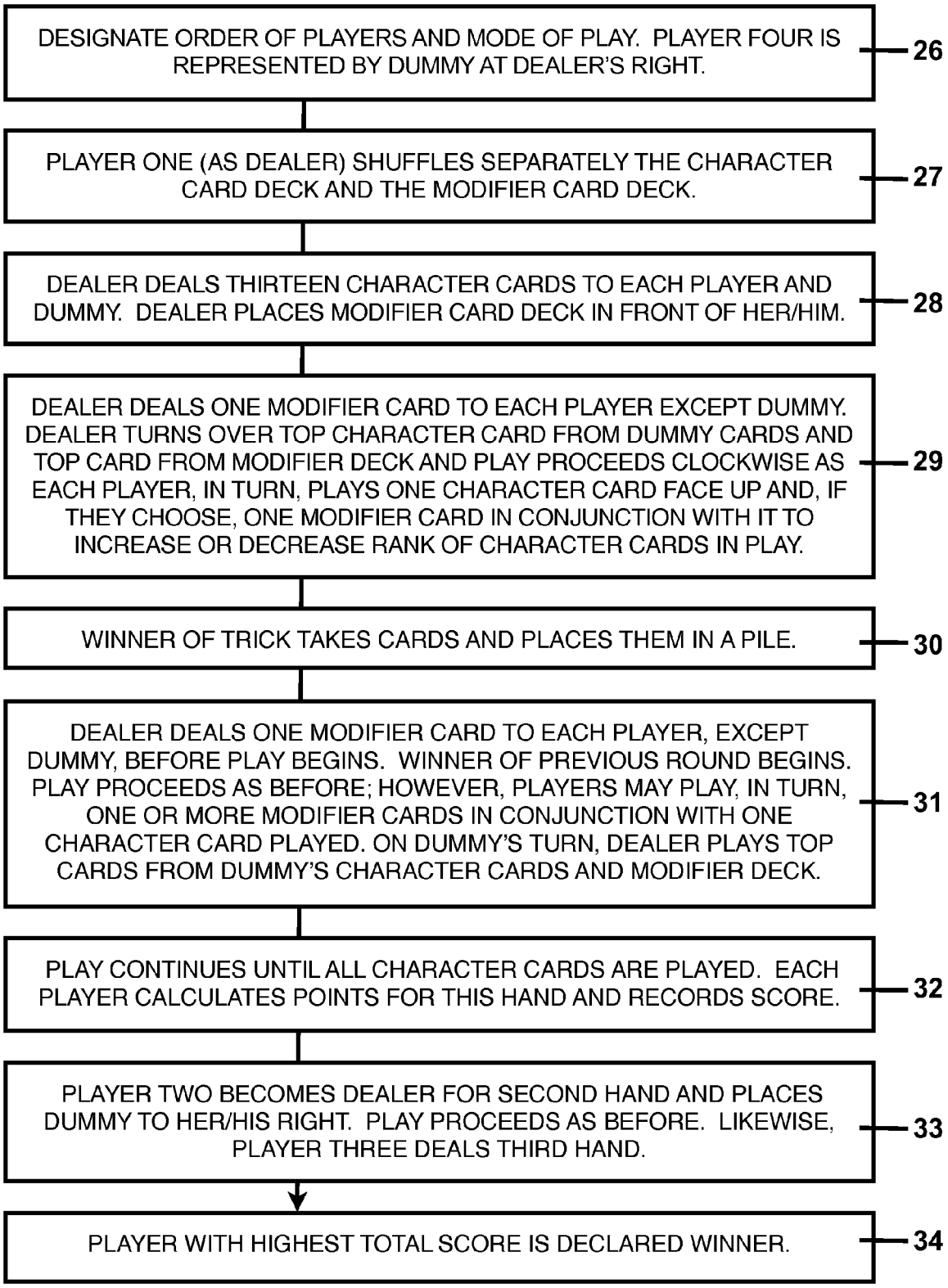
FIG. 4 shows a flow diagram of the game play of the typical 3-player version of the present invention game.

The present invention resembles a basic trick-taking game; however, it uses two different decks of cards—a character card deck (FIG. 1) and a modifier card deck (FIG. 2). Each player's goal is to play a card or cards that is/are higher in value than opponents' cards in order to win a trick in each round of play. Players can improve their chance of winning the trick by using, in their turn, any number of appropriate modifying cards that they possess in their hand to increase the numerical rank value of their played character card or decrease the numerical rank value of the other players' cards. Tricks are collected for points in multiple hands comprising a game. The player with the greatest number of points at the end of the game is declared the winner.

The character card deck (FIG. 1) has 52 different color-illustrated cards (approximately 7 cm by 10 cm in size) arranged in four suits of 13 cards each—numbered consecutively from 1 to 13—representing four major character groups featured in the specific version of this game invention. The character name (feature 1) is located near the top of the card above an illustration of the character (feature 2). Additional information identifying the character may be included below the illustration (feature 3). The numerical rank value (feature 4) is indicated in the upper left and lower right corners of the card.

Within each suit of character cards, 13 numbered rank cards are divided into a number of named hierarchical groups. Cards ranking 13 have the highest value in the deck, and cards ranking 1 have the lowest value in the deck. The hierarchical group to which each character belongs is typically written on the left side of each card (feature 5). In specific versions of this game invention, the character name may be indicated on the left hand side of the character cards (feature 5) and, in this case, the hierarchical group to which the character belongs is represented by a symbol near the bottom of the card (feature 6). Each card can be identified as to suit and rank value by a colored band around the edge of the card (feature 7) and the shape and color of a symbol (feature 8) surrounding the numbered value of each card. Features 4 and 8 are present in the upper left and lower right corners of each character card so that suits and rank values are clearly visible when cards are held-in-hand in a fanned configuration.

Some character cards also belong to specific attribute groups because they share certain characteristics that are important during game play. Symbols (feature 9) near the bottom of the card indicate membership in specific attribute groups.

The modifier card deck (FIG. 2) contains 52 modifier cards that represent different factors that might influence the numerical rank value of character cards. Modifier cards are played to increase the rank value of one's character cards or decrease the value of any character cards played by an opponent. Modifier cards typically increase or decrease appropriate character card rank values by one to ten points. Some modifiers reduce to zero the value of specific character card(s) or character cards belonging to specific attribute groups.

There are several different groups of modifier cards, each one comprising a general type of affecting factor. Each modifier card has the name of the specific modifying factor (feature 10) near the top of the card with an illustration (feature 11) beneath it. The general modifier type (feature 12) is typically indicated below the illustration. A point summary of influences (feature 13) is printed near the center of the card. In some cases, a symbol or symbols (feature 14) is/are depicted near the bottom of the modifier card to assist a player in the appropriate play of the card. A colored band (feature 15) may be present around the edge of the card to additionally assist in the appropriate play of the card.

On the reverse side of the cards, there is depicted an illustration befitting the specific version of this invention game. Cards comprising the character card deck have a different reverse-side illustration than cards comprising the modifier card deck so as to facilitate sorting the cards into their respective decks following game play.

The invention game can be played by two or more players. Here, first, is described the typical 4-player game which constitutes the standard game play. Game play for two, three, and more than four players are described subsequently.

Before play begins, all players involved must first designate the order of players and mode of play. Player One deals the first hand. The order of the remaining players is determined in a clockwise fashion, with Player Two being the player positioned immediately to the left of Player One, and so forth. Before play begins players must decide, by mutual consent, the number of hands that will constitute the game. Typically, the number of hands in a game is a multiple of the number of players so that each player will get equal opportunity to be Dealer (step 16).

Player One shuffles separately the character card deck and the modifier card deck (step 17). Thirteen character cards are dealt face down to each player so that all character cards are dealt out. The modifier deck is placed faced down in front of Player One, who will deal modifier cards to herself/himself and other players at specified times during play (step 18). Each player then takes up her/his dealt cards, holding them in-hand so as to seclude them from view by other players.

Before beginning the first round and all rounds that follow, the Dealer gives one modifier card face down to each player including herself/himself (step 19). Players add the modifier card to their hand. Play for the first trick begins as the person to the Dealer's left places one character card, or character card and modifier card combination, of her/his choice from their cards held-in-hand face up in the area of play (step 20). Any number of modifier cards can be played at once; however, players may only use modifier cards during their turn of play in conjunction with the play of one character card. They may not play modifier cards during or between other players' turns. Additive values on modifier cards apply only to the person who plays the card; subtractive values apply to all players in the round except the person who played the card. Some modifier cards do not raise or lower the numerical rank of character cards by specific point values. These cards benefit the player who plays them by modifying the value of another modifier card, or cards, played in conjunction; or by diminishing or negating the modifying effect of a modifying card played by an opponent. All cards that the player intends to play on her/his turn must be played before the outcome of the round is determined.

Any player in a round cannot play a character card or character/modifier card(s) combination that shares the highest rank score with another player, thus, potentially creating a tie for the trick. The winner of the trick is determined after all players have played in the round.

Play proceeds clockwise until everyone has played (step 20). The trick is won by whoever has played the highest-ranking character card, or character/modifier card(s) combination. The player who wins the trick keeps those cards face down in a pile beside her/him (step 21). Tricks are counted for points after all rounds of the hand have been played.

Play for the second trick begins with the player who won the previous trick playing the first card(s) (step 22). Play proceeds clockwise, in the manner of the first trick (step 20), until everyone has played and the trick is won. In this round, and all subsequent rounds, players may choose, in their turn, to play any number of modifier cards from their cards held-in-hand. Play continues as before until all players have played all their character cards and all tricks have been collected. Some modifier cards may remain unplayed in the hand. Each player calculates her/his points for this hand based on the number of tricks that she/he has won and other points accumulated, and records her/his score (step 23). In the second hand, Player Two becomes the Dealer and play proceeds as before. Player Three and Player Four subsequently deal the third and fourth hands (step 24). Play always proceeds in a clockwise direction for the predetermined number of hands until the game is complete. The player who accumulates the most points after all hands of the game have been played is declared the winner (step 25).

The invention game can also be played by three players with some modification to the aforementioned typical 4-player game. Play proceeds as in the 4-player game, however, the fourth player is represented by a Dummy (step 26). The Dummy is always placed to the Dealer's right. The Dealer operates the Dummy. Modifier cards played by the Dummy affect all players in the game, including the Dummy, in the manner previously described except specific modifier cards that immediately reduce the rank value of all character cards played by opponents to zero. If the Dummy plays this modifier type, the Dummy wins the trick. Play begins with the Dealer shuffling the decks as before (step 27) and dealing out all character cards to the three players and the Dummy so that each has 13 cards (step 28).

Before beginning the first round and all rounds that follow, the Dealer gives one modifier card face down to each player, except the Dummy. The first round of the game begins with the Dealer taking the top character card and the top modifier card from the Dummy and placing them face up in play. Play proceeds clockwise with each person playing one character card and, if they choose, a modifier card in their turn until everyone has played (step 29). The player who wins the trick keeps those cards face down in a pile beside her/him (step 30). If the Dummy wins the trick, these cards are placed in a pile beside the Dummy. The Dummy does not score tricks; however, tricks won by the Dummy reduce the overall number of points that can be accumulated in a hand.

As before, the Dealer gives one modifier card face down to each player, except the Dummy. The second trick begins with the player who won the previous trick placing down the first card(s). During the Dummy's turn, the Dealer turns over the top character card and top modifier card from the Dummy and places them face up in play (step 31). Play continues as before until all character cards in the hand have been played. Tricks are counted and scores are recorded (step 32). Player Two now becomes the Dealer, and places the Dummy to her/his right. Play proceeds in a clockwise manner. Player Three subsequently deals the third hand, placing the Dummy to her/his right before dealing (step 33). The player who accumulates the most points after all hands of the game have been played is declared the winner (step 34).

Figure 5:
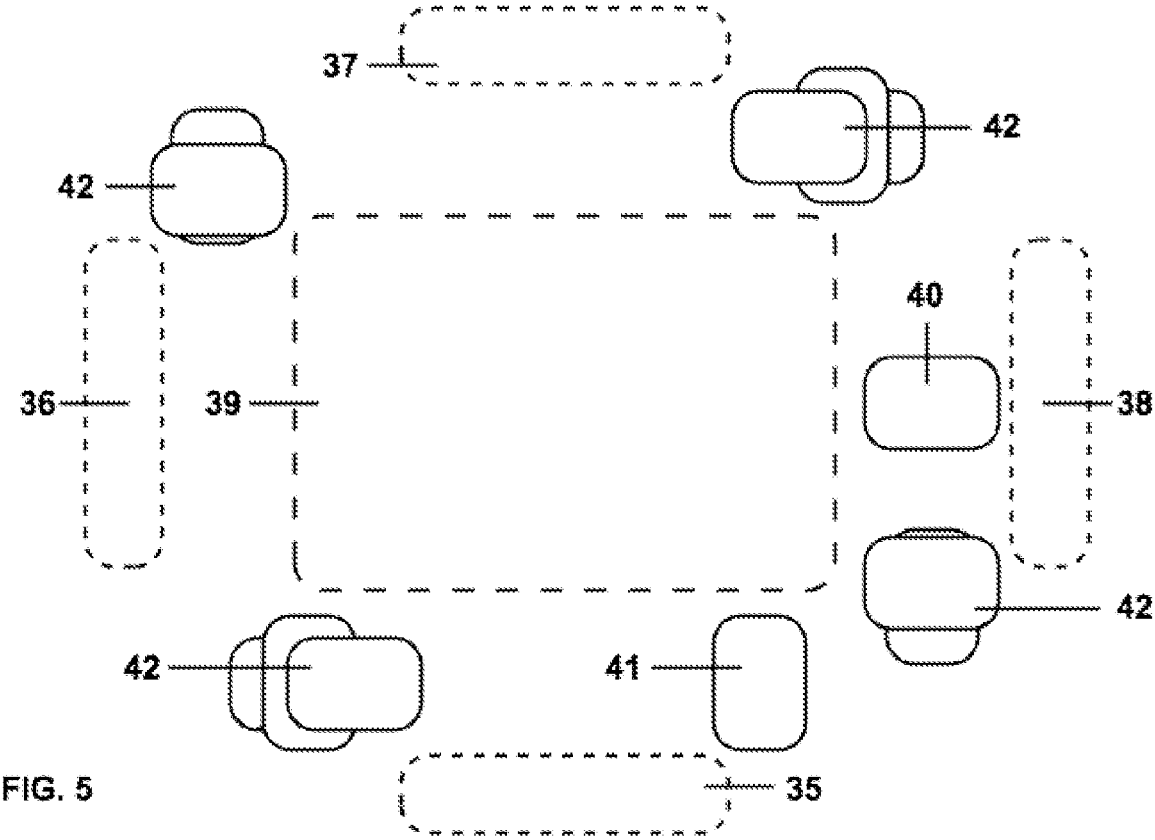
FIG. 5 shows the typical placement of the players and Dummy; card piles comprising the Dummy and modifier deck, and tricks won as situated surrounding the area of play of the present invention game.

FIG. 5 illustrates the typical seating position of Player One (feature 35), Player Two (feature 36), Player Three (feature 37), and the relative position of the Dummy (feature 38) surrounding the area of play (feature 39) in a hand where Player One is Dealer. Character cards dealt to the Dummy are placed at feature 40. The modifier card deck (feature 41) is placed in front of the Dealer. The suggested placement of won tricks is indicated by features 42.

The invention game can also be played by two players with a Dummy, four players with a Dummy, or five or more players with or without a Dummy. In these cases, the Dealer deals out the character card deck until all players have the same number of cards. The Dealer sets the remaining cards aside for this hand, but shuffles them back into the deck before the next hand is dealt. Play proceeds as previously described.

The invention claimed is:

1. A method of playing a trick-taking card game for four players comprising the steps of: providing two pluralities of playing cards configured to be used in said game that are used in conjunction with each other to play said game; the said first plurality are divided into four categories and each card in the said first plurality is assigned a numerical value; the said second plurality are divided into a plurality of categories and each card in said second plurality is assigned a numerical influence value; wherein the object of said game is to accumulate the most points during the game using the following steps: before each hand of play a dealer shuffling separately the said first and second plurality of playing cards, and dealing cards of the said first plurality sequentially, placed face down, to each player in a clockwise manner until all cards of the said first plurality are dealt; the said second plurality of playing cards being placed face down in a pile in front of the dealer who distributes to each player one card, placed face down, from the said plurality at the beginning of each round of play; players holding all cards dealt to them in-hand so as to seclude them from view; the first round beginning with the player to the left of the dealer playing face up one card from the said first plurality of playing cards from their cards held-in-hand and, if they choose, one card from the said second plurality of playing cards from their cards held in-hand in order to raise the numerical value of their played card from the said first plurality of playing cards or lower the numerical value of the played card from the said first plurality of playing cards played by their opponents; play follows clockwise in the same manner by each player in their turn until each has played face up one card from the said first plurality of playing cards from their cards held-in-hand and, if they choose in their turn, one card from the said second plurality of playing cards from their cards held in-hand; no player is allowed to abstain from play; players may not play cards from the said second plurality of playing cards from their cards held-in-hand during another player's turn; the winner of the round being the player who has played the card from the said first plurality of playing cards from their cards held in-hand, or the combination of played cards from the said first and second plurality of playing cards from their cards held in-hand, with the highest total numerical value; playing the second round as the first, with the exception of this round and subsequent rounds in the hand being initiated by the player who has won the previous round, and each player choosing to play from their cards held-in-hand one or more cards from the said second plurality of playing cards in conjunction with one card from the said first plurality of playing cards; play in any one hand continuing until all cards of the said first plurality of playing cards dealt to each player having been played; not all cards of the said second plurality of playing cards necessarily played in any hand of play; players then calculating points accumulated in the hand and recording said points; play continuing in the manner of the first hand until the predetermined number of hands comprising a game have been played; and the player who accumulates the greatest number of points in a game is deemed to be the winner of said game.

2. The method of playing a trick-taking card game of claim 1, wherein: said pluralities of playing cards each having uniform card backs so that each card of the said plurality is indistinguishable from all other cards of the said plurality when viewed from the back side; the said first and second pluralities of playing cards each having a card back illustration that is different from the other plurality of playing cards so as to distinguish one plurality of playing cards from the other when viewed from the back side; and, cards that have different card faces so that no two cards of either plurality of playing cards are identical.

3. The method of playing a trick-taking card game of claim 1, wherein: the said first plurality of playing cards comprises fifty-two different cards divided into four said categories of thirteen cards each that are numbered consecutively from one to thirteen, whereby number one has the lowest numerical value and number thirteen has the highest numerical value.

4. The method of playing a trick-taking card game of claim 1, wherein: the said first plurality of playing cards are further subdivided whereby each card belongs to one or more subcategories.

5. The method of playing a trick-taking card game of claim 1, wherein: the said second plurality of playing cards comprises fifty-two different cards that are divided into a plurality of categories.

6. The method of playing a trick-taking card game of claim 1, wherein: the said second plurality of playing cards possess an instruction element that, when played, can (a) increase or reduce the numerical value of one or more cards of the played cards from the said first plurality of playing cards, (b) diminish or negate the effect of a played card from the said second plurality of playing cards that is played by an opponent, or (c) modify the value of another card from the said second plurality of playing cards when they are played in conjunction.

7. The method of playing a trick-taking card game of claim 1, wherein: the said second plurality of playing cards may be attributed a numerical influence value that is preceded by a plus (+) symbol or minus (−) symbol that, when played in conjunction with a card of the said first plurality of playing cards, may raise or lower the numerical value of played cards from the said first plurality of playing cards according to the numerical influence value depicted on the face side of the played card of the said second plurality of playing cards; additive values as indicated by a plus (+) symbol preceding the numerical influence value apply only to the player who has played them, thus, may only raise the numerical value of the card from the said first plurality of playing cards that they play in conjunction with it; subtractive values as indicated by a minus (−) symbol preceding the numerical influence value apply to all opponent players, thus, may lower the numerical value of one or more cards from the said first plurality of playing cards played in the round with the exception of those played in conjunction with it.

8. The method of playing a trick-taking card game of claim 1, wherein: the card face of the said first plurality of playing cards comprising:

(a) a title feature wherein the name of the card is identified by text;

(b) a graphic feature wherein the name identified by the title feature is the subject of a visual representation that depicts the name;

(c) an editorial feature that is related to the name identified by the title feature in that it serves as a commentary in text on the name identified by the title feature;

(d) a value feature wherein the name identified by the title feature is valued by one number that appears on the card face, each number corresponding to the numerical value of the name relative to the numerical value of other names depicted on other cards in the said first plurality of playing cards;

(e) a category feature wherein the numerical value of the name identified by the title feature is categorized into one of a number of named hierarchical categories, the hierarchical categories comprising a number of numerical values being identified by name in text and/or by a representative graphic feature on all cards possessing said numerical value;

(f) a category feature wherein the name identified by the title feature is categorized into one of four categories identified by a color feature and graphic feature, whereby the color feature, and shape and color of the graphic feature serve to identify which of the four categories the name identified by the title feature belongs; and (g) a category feature wherein the name identified by the title feature is categorized into one or more subcategories that may be independent of numerical value or other aforementioned categories, being depicted by a graphic feature that is also depicted on all other cards that comprise the same said subcategory.

9. The method of playing a trick-taking card game of claim 1, wherein: the card face of the said second plurality of playing cards comprising:

(a) a title feature wherein the name of the card is identified by text;

(b) a graphic feature wherein the name identified by the title feature is the subject of a visual representation that is related to the name;

(c) an editorial feature that is related to the name identified by the title feature in that it serves as a commentary in text on the name identified by the title feature;

(d) a category feature in text and/or one or more graphic features wherein the name identified by the title feature is categorized into a plurality of categories;

(e) an instruction feature in text indicating a specific numerical influence value that is preceded by a plus symbol (+) or a minus (−) symbol; or an instruction feature in text that identifies a numerical effect other than raising or lowering the numerical value of an appropriate card of the said first plurality of playing cards by a specific numerical influence value; and (f) a graphic feature that represents one or more categories or subcategories of said first plurality of playing cards that may be influenced.

10. The method of playing a trick-taking card game of claim 1, wherein: no player may play a card of the said first plurality of playing cards from their cards held-in-hand that is the same numerical value as the card from the said first plurality of playing cards already played by another player so as to create a tie for the highest played numerical value; no player may play a combination of one card of the said first plurality of playing cards from their cards held-in-hand and one or more cards from the said second plurality of playing cards from their cards held-in-hand that together equal the numerical value of a card, or combination of cards, already played by another player so as to create a tie for the highest played numerical value.

11. The method of playing a trick-taking card game of claim 1, wherein one of four players is represented by a dummy using the following rules: the first round of any hand is initiated by the dummy and all subsequent rounds in said hand are initiated by the player who won the previous round; in each round, the dealer deals one card from the said second plurality of playing cards to each player except the dummy; cards of the said first plurality of playing cards dealt face down to the dummy prior to initiating a hand will be turned over by the dealer to show the face side during each turn of play of the dummy; during the turn of the dummy in each round the dealer will turn over the top card from the said first plurality of playing cards dealt to the dummy so as to put the card in play; during the turn of the dummy in each round the dealer will turn over the top card from the said second plurality of playing cards so as to put the card in play; cards from the said second plurality of playing cards played by the dummy raise or lower the numerical value of all cards, or combination of cards, played in the round including cards from the said first plurality of playing cards played by the dummy with the exception of cards from the said second plurality of playing cards that immediately reduce the numerical value of all cards played in the round to zero; the dummy does not score points.

12. The method of playing a trick-taking card game of claim 1, further comprising a number other than four players, but not less than three, using the following rules: the said first plurality of playing cards are dealt until all players have the same number of cards, the remaining cards of the said first plurality of playing cards being set aside until the next hand following which they are shuffled back into the said first plurality of playing cards prior to dealing the subsequent hand.

13. The method of playing a trick-taking card game of claim 1, further comprising a number other than four players, but not less than three, wherein one player is represented by a dummy using the following rules: the said first plurality of playing cards are dealt until all players have the same number of cards, the remaining cards of the said first plurality of playing cards being set aside until the next hand following which they are shuffled back into the said first plurality of playing cards prior to dealing the subsequent hand.

* * * * *